US010827850B2

(12) United States Patent
Anastasov

(10) Patent No.: US 10,827,850 B2
(45) Date of Patent: Nov. 10, 2020

(54) MATTRESS WITH SENSORS AND REPLACEMENT INDICATOR AND METHODS OF MAKING AND USING THE SAME

(71) Applicant: Medline Industries, Inc., Northfield, IL (US)

(72) Inventor: Vladimir Anastasov, Chicago, IL (US)

(73) Assignee: Medline Industries, Inc., Northfield, IL (US)

( * ) Notice: Subject to any disclaimer, the term of this patent is extended or adjusted under 35 U.S.C. 154(b) by 556 days.

(21) Appl. No.: 15/461,292

(22) Filed: Mar. 16, 2017

(65) Prior Publication Data

US 2018/0263378 A1 Sep. 20, 2018

(51) Int. Cl.

| | |
|---|---|
| ***A47C 31/00*** | (2006.01) |
| ***G08B 5/36*** | (2006.01) |
| ***G08B 25/08*** | (2006.01) |
| ***G08B 21/04*** | (2006.01) |
| ***G08B 25/10*** | (2006.01) |
| ***A61G 7/05*** | (2006.01) |
| ***A61G 7/057*** | (2006.01) |

(52) U.S. Cl.

CPC ..... *A47C 31/00* (2013.01); *A61G 7/05* (2013.01); *G08B 5/36* (2013.01); *G08B 21/0461* (2013.01); *G08B 25/08* (2013.01); *G08B 25/10* (2013.01); *A61G 7/057* (2013.01); *A61G 2203/34* (2013.01)

(58) Field of Classification Search

CPC ..... A47C 31/00; A61G 7/05; A61G 2203/34; A61G 7/057; G08B 25/08; G08B 21/0461; G08B 25/10; G08B 5/36

See application file for complete search history.

(56) References Cited

U.S. PATENT DOCUMENTS

| | | | | |
|---|---|---|---|---|
| 4,066,072 | A | 1/1978 | Cummins | |
| 5,809,591 | A * | 9/1998 | Capaldi | A61G 7/1015 5/83.1 |
| 8,419,660 | B1 | 4/2013 | Shaw | |
| 8,672,842 | B2 | 3/2014 | Kenalty et al. | |
| 8,826,473 | B2 | 9/2014 | Flanagan et al. | |
| 9,009,898 | B2 | 4/2015 | Morimura et al. | |
| 10,254,153 | B2 * | 4/2019 | Moore | G01G 23/3721 |
| 10,561,550 | B2 * | 2/2020 | Bobey | A61G 7/05776 |
| 2007/0056101 | A1 | 3/2007 | Mahajan et al. | |
| 2015/0121625 | A1 * | 5/2015 | Myers | A47C 21/00 5/636 |

(Continued)

*Primary Examiner* — Myles A Throop

(74) *Attorney, Agent, or Firm* — Philip H. Burrus, IV

(57) ABSTRACT

A mattress (100) includes one or more layers (101,102,103) of material, and one or more pressure sensors (104,105,106). A control circuit (203), operable with the pressure sensors, is operable with a user interface (115). The control circuit presents on the user interface one of three color-coded indications. When a sensed pressure detected by the pressure sensors is below a first threshold (603), the control circuit presents a first color-coded indication on the user interface. When the sensed pressure (605) is between the first predefined sensor threshold and a second predefined sensor threshold (604), the control circuit presents a second color-coded indication on the user interface. When the sensed pressure is above the second predefined pressure threshold, the control circuit presents a third color-coded indication on the user interface.

20 Claims, 5 Drawing Sheets

(56) References Cited

U.S. PATENT DOCUMENTS

| | | | | |
|---|---|---|---|---|
| 2015/0128354 | A1 | 5/2015 | Greenstein et al. | |
| 2015/0141852 | A1 | 5/2015 | Dusanter et al. | |
| 2015/0164238 | A1* | 6/2015 | Benson | G16H 50/30 340/540 |
| 2016/0345746 | A1* | 12/2016 | Myers | A47C 31/123 |
| 2017/0027792 | A1 | 2/2017 | Lafleche et al. | |
| 2020/0060599 | A1* | 2/2020 | Monson | A61B 5/207 |

* cited by examiner

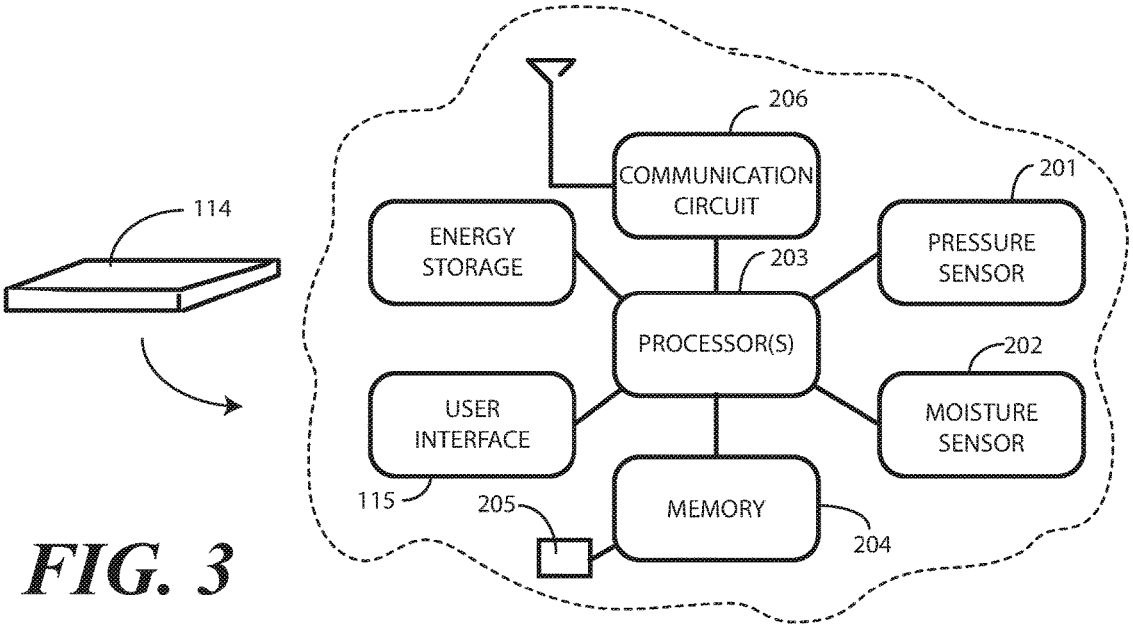
FIG. 3
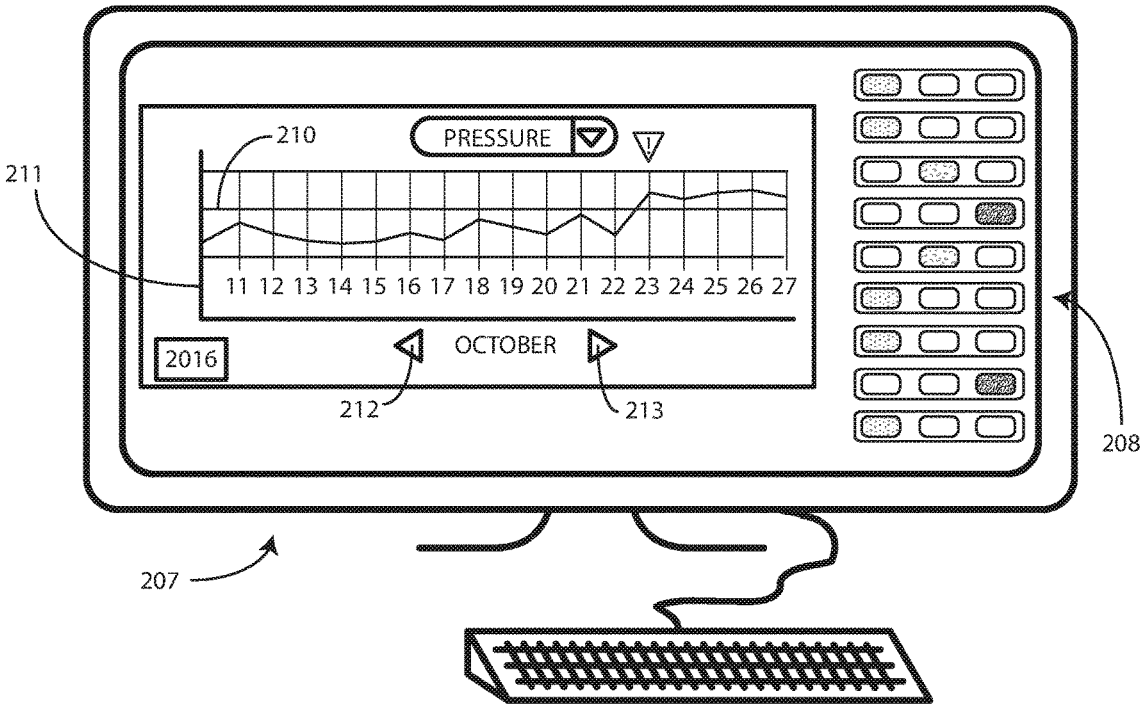

MATTRESS WITH SENSORS AND REPLACEMENT INDICATOR AND METHODS OF MAKING AND USING THE SAME

BACKGROUND

Technical Field

This disclosure relates generally to mattresses, and more particularly to mattresses with sensors.

Background Art

Mattresses and other human support devices have limited lifespans. At the same time, knowing when a mattress should be replaced is a challenge. A mattress may have deteriorated components within, but may look relatively new externally. Since the internal components of the mattress are not visible, it can be very difficult to know whether the limited lifespan of the mattress has been reached or exceeded.

This is especially true in nursing homes, long-term care facilities, and health care facilities. These places frequently have many mattresses, each of which is being used more than for just sleeping at night. A bedridden patient, for example, may spend the entire day atop a mattress. This is in contrast to home use where a person may only spend six to eight hours per day on a mattress. The large number of mattresses and increased loading upon the mattresses can make it nearly impossible for a technician or health care services provider to know when the mattress needs to be replaced. Mattresses that have exceeded their lifespans can, at a minimum, make sleeping difficult. Worse, mattresses that have exceeded their lifespans can, in some instances, cause injuries such as pressure ulcers.

Further complicating the problem is that many mattresses in such institutions are often manufactured from different components. Air mattresses, foam mattresses, and spring mattresses may all be in use. Each may have different care requirements. Some may be "flip" mattress that require rotation, while others may be "no-flip." Each mattress may have a different lifespan. The weights of patients using the mattress may differ. This myriad of factors makes judging the lifespan of each mattress all but impossible. It would be advantageous to have an improved mattress.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present disclosure.

FIG. 3 illustrates one explanatory control and communication system for one or more mattresses configured in accordance with one or more embodiments of the disclosure.

Figure 1:
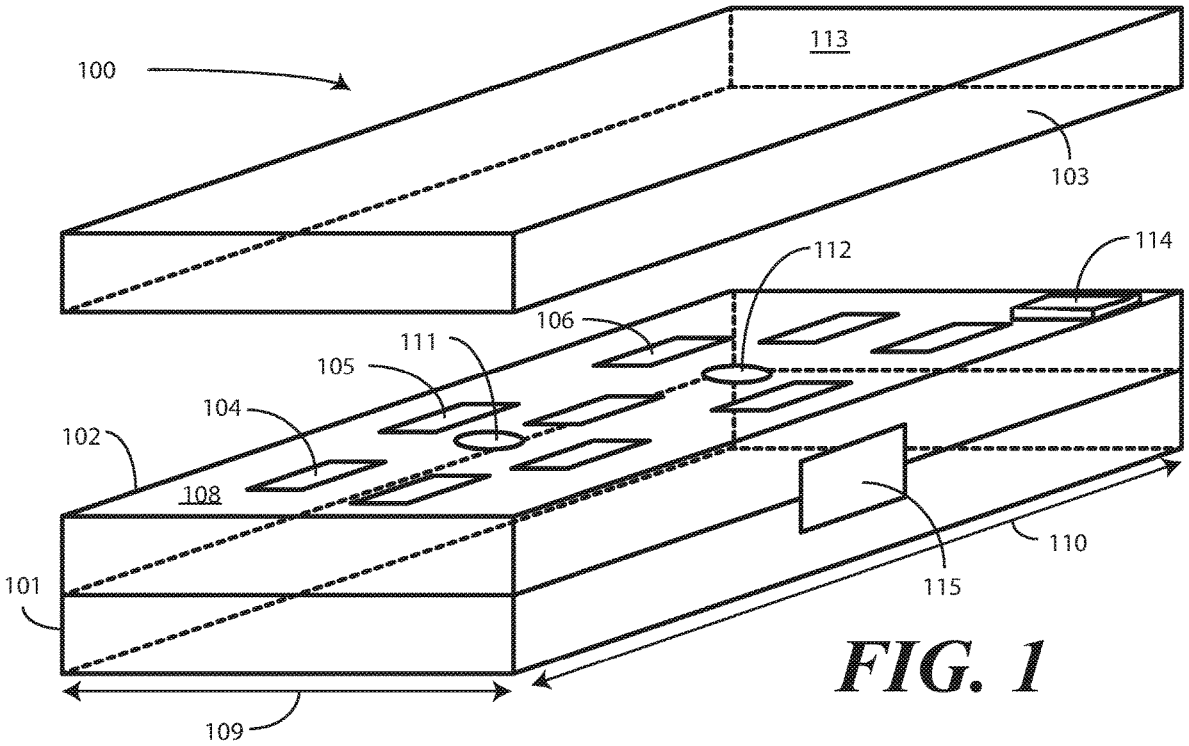
FIG. 1 illustrates an exploded view of one explanatory mattress in accordance with one or more embodiments of the disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION OF THE DRAWINGS

Before describing in detail embodiments that are in accordance with the present disclosure, it should be observed that the embodiments reside primarily in combinations of method steps and apparatus components related to determine when a mattress should be replaced. Any process descriptions or blocks in flow charts should be understood as representing modules, segments, or portions of code that include one or more executable instructions for implementing specific logical functions or steps in the process. Alternate implementations are included, and it will be clear that functions may be executed out of order from that shown or discussed, including substantially concurrently or in reverse order, depending on the functionality involved. Accordingly, the apparatus components and method steps have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

Embodiments of the disclosure do not recite the implementation of any commonplace business method aimed at processing business information, nor do they apply a known business process to the particular technological environment of the Internet. Moreover, embodiments of the disclosure do not create or alter contractual relations using generic computer functions and conventional network operations. Quite to the contrary, embodiments of the disclosure employ methods that, when applied to properly equipped mattresses and/or their corresponding user interface technology, improve the functioning of the overall system itself by and improving the overall user experience to overcome problems specifically arising in the realm of the technology associated with mattress-user interaction.

Embodiments of the disclosure are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions.

As used herein, components may be "operatively coupled" when information can be sent between such components, even though there may be one or more intermediate or intervening components between, or along the connection path. The terms "substantially" and "about" are used to refer to dimensions, orientations, or alignments inclusive of manufacturing tolerances. Thus, a "substantially orthogonal" angle with a manufacturing tolerance of plus or minus two degrees would include all angles between 88 and 92, inclusive. Also, reference designators shown herein in parenthesis indicate components shown in a figure other than the one in discussion. For example, talking about a device (10) while discussing figure A would refer to an element, 10, shown in figure other than figure A. Further, it is expected that one of ordinary skill, notwithstanding possibly significant effort and many design choices motivated by, for example, available time, current technology, and economic considerations, when guided by the concepts and principles disclosed herein will be readily capable of generating embodiments of the disclosure with minimal experimentation.

As noted above, nursing homes, long-term care facilities, and health care facilities have little knowledge of whether mattresses have exceeded their useful lives. This is due in part to the fact that there is little or no visibility of the interior components of the mattress from outside the mattress. However, it is known that mattresses lose—over time—their pressure redistribution capability. Illustrating by example the air pockets in a foam layer of a mattress may degrade, thereby causing the mattress to sag along its surface and/or not properly support the weight of a user. This frequently happens in the mid-section of the mattress.

When this occurs, at a minimum, the mattress becomes difficult or uncomfortable to sleep upon. However, in extreme situations, a person's torso may effectively rest on a bedframe with no support whatsoever. Embodiments of the disclosure contemplate that this can lead to pressure ulcers and other ailments.

Embodiments of the disclosure work to solve this problem by providing one or more pressure sensors that are embedded within the layers and/or surfaces of a mattress. In one or more embodiments, the pressure sensors are accompanied by one or more moisture sensors. Either or both of the pressure sensor(s) and/or the moisture sensor(s) can be calibrated as a function of any of the size of the mattress, the material from which the mattress is constructed, the number of layers within the mattress, and the weight of the person who will be using the mattress. Other calibration factors will be obvious to those of ordinary skill in the art having the benefit of this disclosure.

Once the one or more sensors are calibrated, they can work to determine when the mattress exceeds its useful lifespan. Additionally, the one or more sensors can be used to monitor patient characteristics at the same time, including presence upon the mattress, weight gain or loss, and mattress usage patterns. In one or more embodiments, when any of the sensors determines that a sensed level has exceeded a predefined threshold, it can indicate that the mattress has exceeded its useful life on a user interface.

Illustrating by example, when a pressure sensor detects an amount of pressure exceeding a predefined threshold that is a function of a calibrated level, one or more processors operable with the pressure sensor can present an indication on a user interface alerting a technician, caregiver, or health care services provider that the mattress needs to be replaced.

In one or more embodiments, the user interface is simplified so that persons without knowledge of mattress construction, technical specifications, or features, and/or persons without any technical expertise, can determine that the mattress should be replaced. Advantageously, embodiments of the disclosure guide such persons into action when a mattress needs replacement. In one or more embodiments, warning signals are further provided so that procurement and logistics professionals can ensure that the proper inventory of mattresses is on hand when replacement is required.

In one or more embodiments, the user interface includes a display or a plurality of light sources. Of course, a combination of the two can be used as well. In one or more embodiments, a plurality of light sources, operable with a control circuit in the mattress, selectively present one of three color-coded indications to indicate whether a mattress is within its useful lifespan, is approaching the end of its useful lifespan, or has exceeded its useful lifespan.

In one embodiment, the light sources provide a visual cuing by presenting one of green light, yellow light, or red light, each of which indicates whether mattress replacement is required. For example in one embodiment where the lights are green, the mattress is within its useful lifespan and no replacement is required. When the lights are yellow, the mattress is approaching the end of its useful lifespan. Accordingly, purchasing managers, controllers, or logistics personnel should, ideally, begin ordering a replacement mattress. When the light is red, the mattress has exceeded its useful lifespan and requires replacement. In one or more embodiments a removable memory device or wireless communication device can collect and/or transmit data as the various states occur so that professionals can use this information to manage mattress fleets.

In one or more embodiments, a mattress includes one or more layers of material and one or more pressure sensors. In one or more embodiments, the pressure sensors are disposed between a first layer of material and a second layer of material.

The mattress also includes a control circuit that is operable with the one or more pressure sensors. A user interface is operable with the control circuit. Depending upon where the mattress is relative to its useful lifespan, the control circuit selectively presents on the user interface one of three color-coded indications. As used herein, the "useful lifespan" is defined as the period of time, during usage, when the mattress performs in accordance with factory specified tolerances. Once performance in any area, including compression resistance, weight support, flatness, and so forth, is out of the specification range set forth by the manufacturer, the mattress is considered to have exceeded its useful lifespan.

When a sensed pressure detected by the one or more pressure sensors is below a first predefined pressure threshold, the control circuit presents a first color-coded indication on the user interface. When the sensed pressure is between the first predefined sensor threshold and a second predefined sensor threshold, the control circuit presents a second color-coded indication on the user interface. When the sensed pressure is above the second predefined pressure threshold, the control circuit presents a third color-coded indication on the user interface.

In one embodiment, the first color-coded indication comprises a green light presentation indicating that the mattress is within its useful lifespan. In one embodiment, the second color-coded indication comprises a yellow light presentation indicating that the mattress is approaching the useful lifespan. In one embodiment, the third color-coded indication comprises a red light presentation indicating that the mattress has exceeded the useful lifespan.

Figure 2:
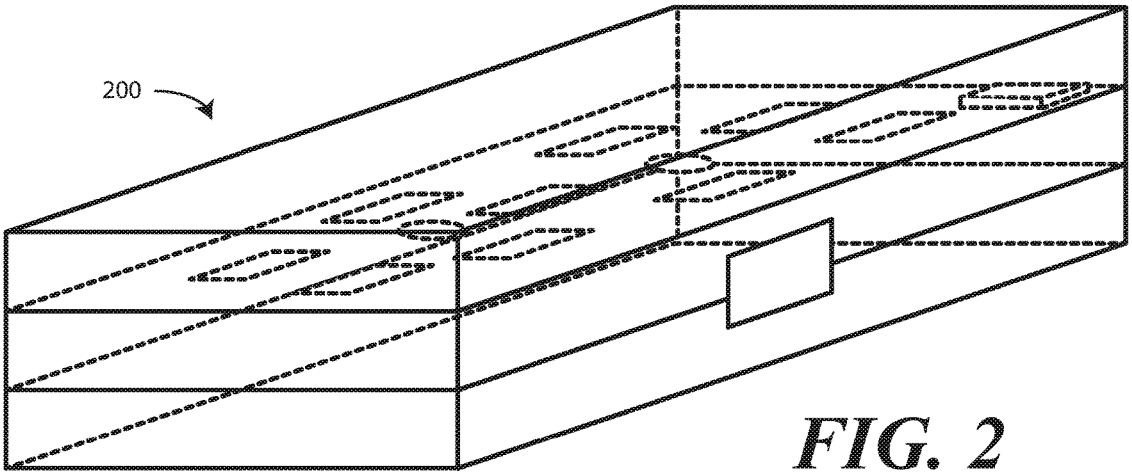
FIG. 2 illustrates one explanatory mattress in accordance with one or more embodiments of the disclosure.

Turning now to FIG. 1, illustrated therein is an exploded view of one explanatory mattress 100 in accordance with one or more embodiments of the disclosure. The assembled mattress 200 is shown in FIG. 2. Referring again to FIG. 1, in one embodiment, the mattress 100 comprises one or more layers 101,102,103. Each of these layers 101,102,103 can be manufactured from a common material or different materials.

Illustrating by example, in one embodiment each layer 101,102,103 is manufactured from foam. The foam may be the same in each layer 101,102,103, or may be different. More supportive foam, for example, may be used in layer 101, while a softer, more comfortable foam may be used in layer 103. Alternatively, layer 101 may be an air filled or spring filled chamber, while layers 102,103 are manufactured from foam. The illustrative layered construction is explanatory only. Other constructions of mattresses will be obvious to those of ordinary skill in the art having the benefit of this disclosure.

As shown in FIG. 1, in one or more embodiments one or more pressure sensors 104,105,106 can be disposed between the one or more layers 101,102,103 of the mattress 100. In one embodiment, the one or more pressure sensors 104,105,106 are disposed between an uppermost layer, i.e., layer 103, and a second most uppermost layer, i.e., layer 102. As will be described in more detail below, other sensors, including moisture sensors 111,112 and/or temperature sensors can be incorporated into the mattress 100 as well.

In one or more embodiments, each pressure sensor 104,105,106 comprises a capacitor that includes two conductive plates and an intervening insulating layer that electrically isolates the conductive plates. When pressure is applied to each of the plates toward the insulating layer, the insulating layer compresses, thereby, changing the distance between the conductive plates. When this occurs, the capacitance of the pressure sensor 104 is changed. This allows a control circuit, described in more detail with reference to FIG. 2 below, to measure the amount of compression, and therefore the amount of pressure by measuring the change in capacitance. While a capacitive sensor is one type of pressure sensor, others will be obvious to those of ordinary skill in the art having the benefit of this disclosure. For example, in another embodiment, resistive pressure sensors are used instead of capacitive sensors. In resistive sensors, pressure causes the impedance of the sensor to change, thereby allowing a control circuit to monitor changes in resistance that vary according to pressure.

In one or more embodiments, the pressure sensors 104,105,106 are arranged in an array 107. The array 107 can be defined such that the pressure sensors 104,105,106 are distributed across a major face 108 of one of the layers 102 of the mattress 100 where layer failures are likely to occur. For example, some of the pressure sensors 104,105,106 of the array 107 will be located in central regions of the second uppermost layer 102 so that they will be disposed beneath a location where a person is most likely to sleep.

In one or more embodiments, the pressure sensors 104,105,106 are calibrated such that at least a predetermined force is required prior to their measuring pressure. As the uppermost layer 103 applies at least some pressure to the pressure sensors 104,105,106 due to the action of gravity, each pressure sensors 104,105,106 may be calibrated to neglect this pressure as a minimum threshold. For example, requiring at least a predetermined force, such as 60 or 80 pounds, to be applied to the pressure sensors 104,105,106 prior to presenting a pressure signal can add beneficial hysteresis to the system and prevents nuisance tripping.

In another embodiment, the one or more pressure sensors 104,105,106 can be configured as strips and arranged in a matrix. Rather than having conductive plates, in another embodiment each pressure sensor 104,105,106 can include conductive strips spanning all or a portion of either the width 109 of the mattress 100 or the length 110 of the mattress. Some pressure sensors can be disposed between the uppermost layer 103 and the second uppermost layer 102, with those pressure sensors spanning the width 109 of the mattress 100, while other pressure sensors can be disposed between the second uppermost layer 102 and the bottom layer 101, with those pressure sensors spanning the length 110 of the mattress 100. Other configurations of pressure sensors 104,105,106 will be obvious to those of ordinary skill in the art having the benefit of this disclosure.

In one or more embodiments, other sensors can be included with the pressure sensors 104,105,106. For example, in this illustrative embodiment one or more moisture sensors 111,112 are included. In this illustrative embodiment, the moisture sensors 111,112 are disposed between an uppermost layer, i.e., layer 103, and a second most uppermost layer, i.e., layer 102. This allows the moisture sensors 111,112 to detect moisture only after it has passed through the uppermost layer 103 in this illustrative embodiment. In other embodiments, the moisture sensors 111,112 can be placed in other locations, such as on the top major surface 113 of the uppermost layer 103. Other locations for the moisture sensors 111,112 will be obvious to those of ordinary skill in the art having the benefit of this disclosure. Also note that while two moisture sensors 111,112 are shown in FIG. 1 for illustration, it will be obvious to those of ordinary skill in the art having the benefit of this disclosure that fewer or more moisture sensors 111,112 can be used. In some embodiments, only one moisture detector will be used. In other embodiments, three or more moisture detectors will be used.

In one or more embodiments, the moisture sensors 111,112 detect not only the presence of moisture between the layers 102,103, but also the amount of moisture as well. This can indicate various forms of context. The moisture sensors 111,112 can comprise an impedance sensor that measures impedance defined between electrodes. The presence of moisture changes the impedance, which can be detected by a control circuit. The moisture sensors 111,112, in one embodiment, are configured to detect acidity, sodium, ammonia, and other characteristics as well. For example, the moisture sensors 111,112 can include galvanic sensors to determine not only the amount of moisture, but whether the moisture is due to natural or man-made factors, or combinations thereof. Other forms of moisture detectors will be obvious to those of ordinary skill in the art having the benefit of this disclosure.

Embodiments of the disclosure contemplate that when the mattress 100 is used in nursing homes, long-term care facilities, and health care facilities, some patients will be bed-ridden or otherwise confined to the mattress 100 for long periods of time. Accordingly, urinary accidents can occur. Such accidents may cause moisture to permeate one or more of the layers 101,102,103 of the mattress 100. This can be harmful to the person, as it can contribute to maladies such as pressure ulcers, infections, sores, and skin conditions. Accordingly, in one or more embodiments, when moisture is detected between one or more of the layers 101,102,103, embodiments of the disclosure contemplate that the mattress must be replaced.

While only pressure sensors 104,105,106 and moisture sensors 111,112 are shown in FIG. 1, it is contemplated that additional sensors configured to monitor additional conditions can be included as well. For example, other sensors that may contribute to user maladies, such as the development of bedsores, can be included. Temperature sensors, humidity sensors, motion sensors, geolocation sensors, and so forth can be included with the pressure sensors 104,105, 106 and the moisture sensors 111,112. Other types of sensors will be obvious to those of ordinary skill in the art having the benefit of this disclosure.

In one or more embodiments, each of the pressure sensors 104,105,106 and the moisture sensors 111,112 are operable with a control unit 114 and a user interface. Turning now to FIG. 3, each of these components will be described in more detail.

In one or more embodiments, the control unit 114 and its corresponding pressure sensors 201 are operable to detect a compression force applied to the pressure sensors 201 and convert it into electronic signals that can be processed by a control circuit 203. Similarly, the moisture sensors 202 are operable to detect the presence and/or an amount of moisture and convert those measurements into electronic signals that can be processed by the control circuit 203.

In one embodiment, the control circuit 203 comprises one or more processors. The control circuit 203, in one or more embodiments, is responsible for performing the various functions of the control unit 114. The control circuit 203 can be a microprocessor, a group of processing components, one or more Application Specific Integrated Circuits (ASICs), programmable logic, or other type of processing device.

In one embodiment, the control circuit 203 can be configured to process and execute executable software code to perform the various functions of the control unit 114. A storage device, such as memory 204, can be used to store any executable software code used by the control circuit 203 for weight scale operation. The executable software code used by the control circuit 203 can be configured as one or more modules that are operable with the control circuit 203. Such modules can store instructions, control algorithms, and so forth. The instructions can instruct processors or the control circuit 203 to perform the various steps, including receiving pressure and/or moisture measurements from the pressure sensors 201 and/or the moisture sensors 202, actuating the user interface 115, receiving user inputs from the various user interface components of the control unit 114, and the corresponding methods described below.

The pressure sensors 201 and/or moisture sensors 202 may deliver pressure and/or moisture measurements to the control circuit 203 directly in one or more embodiments. Alternatively, the pressure sensors 201 and/or moisture sensors 202 may deliver electronic signals to the control circuit 203 that are subsequently processed by the control circuit 203 to determine the pressure and/or moisture measurements. The control unit 114 may include signal-processing components, including analog to digital converters, registers, and other data processing components. One, two, three, four, or more pressure sensors 201 and moisture sensors 202 can be included in the control unit 114 as noted above.

In one or more embodiments, a user interface 115 is operable with the control circuit 203. The user interface 115 can take any of a number of forms. For example, in one embodiment, the user interface 115 comprises a display. In other embodiments, the user interface 115 can comprise a plurality of light sources. In still other embodiments, the user interface 115 can include a combination of a display and a plurality of light sources. Other forms of user interfaces will be obvious to those of ordinary skill in the art having the benefit of this disclosure. Where the user interface 115 includes a display, the display be a liquid crystal display, an organic light emitting diode display, an active matrix organic light emitting diode display, or other display operable to present indicia to a user. In at least one embodiment, the user interface 115 is touch-sensitive so as to define a user input device for the control unit 114.

Figure 4:
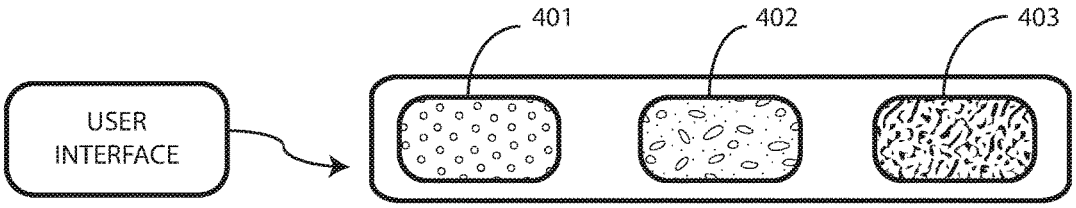
FIG. 4 illustrates one explanatory user interface configured in accordance with one or more embodiments of the disclosure.

Turning briefly to FIG. 4, illustrated therein is one explanatory user interface 400. In this illustrative embodiment, the user interface 400 comprises a plurality of light sources. In this illustrative example, the plurality of light sources includes three light sources: a first light source 401, a second light source 402, and a third light source 403. The light sources can be laser-based, diode based, filament based, or other types of light sources. Illustrating by example, in one embodiment the plurality of light sources comprises an array of three light emitting diode light sources.

Figure 5:
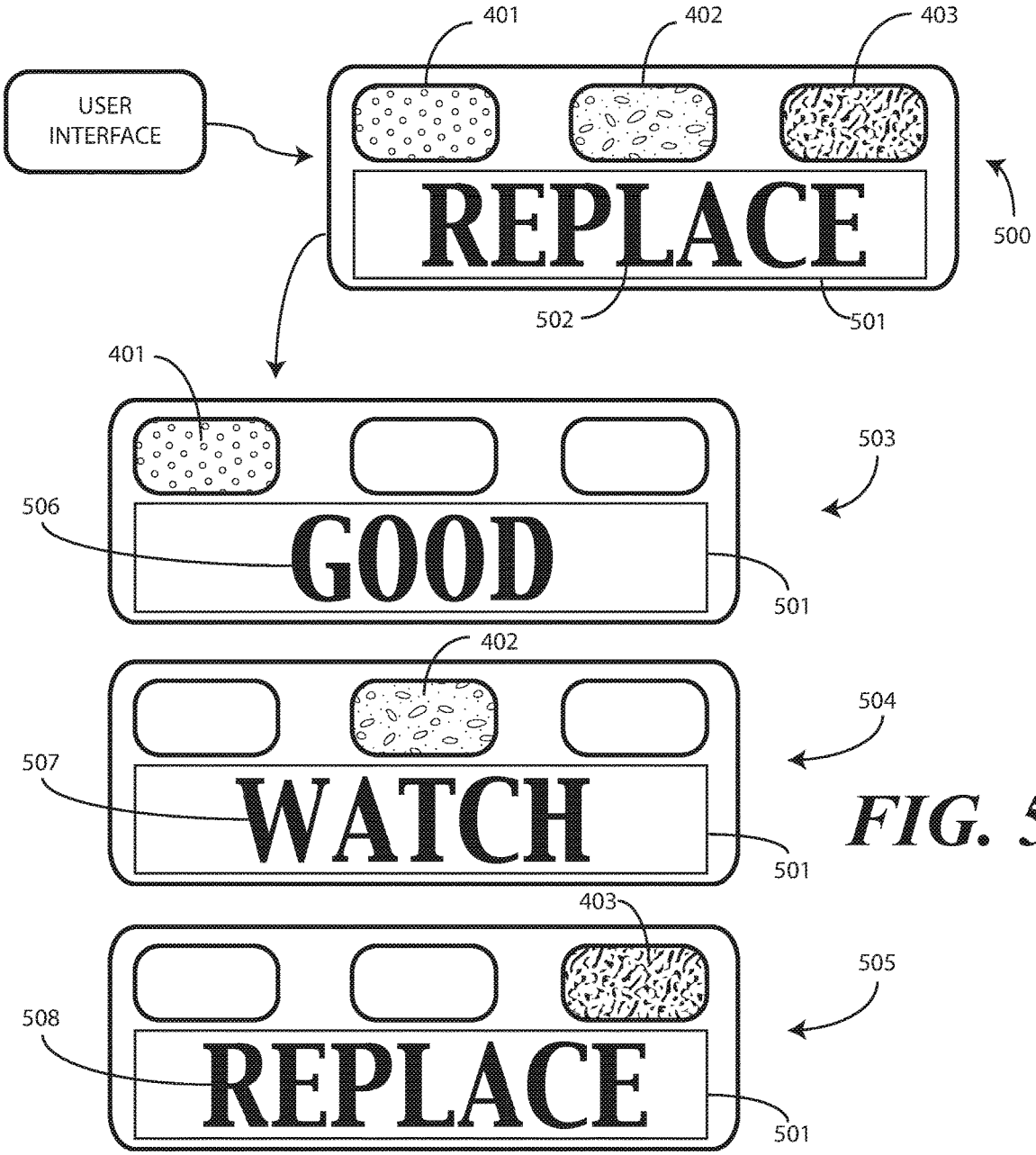
FIG. 5 illustrates an alternate user interface configured in accordance with one or more embodiments of the disclosure.

By contrast, turning now to FIG. 5, illustrated therein is a second user interface 500. This user interface 500 includes a first light source 401, a second light source 402, and a third light source 403, but also includes a display 501. In one or more embodiments, these light sources are separate from the display 501 so that they can easily be identified by a user. The user interface 500 of FIG. 5 offers the ability of presenting visual indicia 502 in addition to colored indications to a user. For example, when a mattress (100) is within its useful lifespan, the user interface 500 can be in a first state 503, where a first light source 401 is illuminated and information 506 can be presented on the display 501 indicating the same, namely, that the mattress (100) is within its useful lifespan. In this illustrative embodiment, the information 506 comprises the word "GOOD," indicating that the mattress (100) is still suitable or use.

However, when the mattress (100) is approaching the end of its useful lifespan, in one or more embodiments the user interface 500 can transition to a second state 504. In the second state 504, the second light source 402 is illuminated. Additionally, different information 507 is presented on the display 501. The second light source 402 and the different information 507 indicate that the mattress (100) is approaching the end of its useful lifespan. Accordingly, a person in charge of replacing mattresses should monitor the mattress (100), and more particularly, the user interface 500, because the time when replacement is required is approaching. In this illustrative embodiment, the different information 507 comprises the word "WATCH," thereby indicating that the mattress (100) and/or user interface 500 should be monitored to replace the mattress (100) when the user interface 500 transitions to the third state 505.

When the mattress (100) exceeds its useful lifespan, in one or more embodiments the user interface 500 changes to the third state 505 in which the third light source 403 is illuminated and third information 508 is presented on the display 501. In this embodiment, the third information 508 comprises the word "REPLACE," indicating that the mattress (100) should be replaced. While words such as GOOD, WATCH, and REPLACE are suitable as information indicating the state within—or beyond—the useful lifespan of a mattress (100), other information suitable for presentation on the display 501 will be obvious to those of ordinary skill in the art having the benefit of this disclosure.

Turning now back to FIG. 3, in one or more embodiments the light sources are operable with the control circuit 203 to selectively present one of three color-coded indications. For example, in one embodiment the first light source (401) comprises a green light emitting diode, the second light source (402) comprises a yellow light emitting diode, and the third light source (403) comprises a red light emitting diode. In another embodiment, each of the first light source (401), the second light source (402), and the third light source (403) each comprise white light emitting diodes capable of emitting any of red, green, yellow, or white light. While light emitting diodes are one example of light sources, others will be obvious to those having the benefit of this disclosure.

In one or more embodiments, mattress lifespan information 205, is stored within the memory 204 of the control unit 114. For example, when measuring pressure between the one or more layers (101,102,103) of the mattress (100), the control circuit 203 can record pressure measurements in the memory 204. Moisture information can be recorded in a similar manner. Advantageously, in one or more embodiments the control unit 114 and its user interface 115 can present colored signals to provide a visual cuing mechanism regarding in which state the mattress (100) may be along its useful lifecycle.

Illustrating by example, the control circuit 203 can cause one of the first light source (401), the second light source (402), or the third light source (403) to present one of green light, yellow light, or red light. Alternatively, where the light sources are not included, these colors can be presented along the display (404) of the user interface 115. The color of light can indicate whether mattress replacement is soon to be required or is needed at the moment.

If, for example, the first light source (401) is illuminated, this can comprise a visual cue that the mattress is within its useful lifecycle. By contrast, when the second light source (402) is illuminated, this can define a visual cue that the mattress (100) is approaching the end of it useful life and will need replacing soon. This is a cue to procurement personnel that inventories of mattresses should be such that the mattress (100) can be replaced in a timely manner when the third light source (403) is illuminated. When the third light source (403) is illuminated, this can comprise a visual cue that the mattress (100) has reached the end of its useful life and needs to be replaced.

Accordingly, in one or more embodiments the control circuit 203 is operable to selectively cause one of the first light source (401), the second light source (402), or the third light source (403) to actuate after detecting the pressure and/or moisture between the various layers (101,102,103) of the mattress (100), as determined by the pressure sensors 201 and/or moisture sensors 202. Illustrating by example, as will be shown in more detail below with reference to FIG. 6, in one or more embodiments when the pressure determined by the pressure sensors 201 is below a first predefined threshold the control circuit 203 causes at least one light source of the plurality of light sources to present a first color indication. In this illustrative embodiment, the control circuit 203 causes the first light source (401) to emit green light. In one or more embodiments, the first color indication indicates that the mattress has not reached the end of its useful life and does not need to be replaced.

However, when the pressure is between the first predefined threshold and a second predefined threshold, which is higher than the first predefined threshold, in one embodiment the control circuit 203 causes at least one light source of the plurality of light sources to present a second color indication. In this illustration, the control circuit 203 can cause the second light source (402) to emit yellow light. In one or more embodiments, this second color indication indicates that the mattress (100) is approaching the end of its useful life and will need to be replaced soon.

When the pressure is above the second predefined threshold, the control circuit 203 can cause at least one light source of the plurality of light sources to present a third color indication. In this illustrative embodiment, the third color indication occurs when the control circuit 203 causes the third light source (403) to emit red light. In one or more embodiments, this third color indication indicates that the mattress (100) has exceeded its useful life and needs to be replaced.

These paragraphs describe the operation of the pressure sensors 201. Embodiments of the disclosure contemplate that when moisture penetrates any of the one or more layers (101,102,103) of the mattress (100), the mattress (100) needs to be replaced. Consequently, in one or more embodiments where the moisture sensors 202 are included, when any moisture is detected between an uppermost layer (103) and a second uppermost layer (102), the control circuit 203 causes the third light source (403) to emit red light. In one or more embodiments, this third color indication indicates that the mattress (100) has exceeded its useful life and needs to be replaced.

The control unit 114 can include other components. The other components may include a video input component such as an optical sensor, an audio input component such as a microphone, and a mechanical input component such as button or key selection sensors. The other components can also include a touch pad sensor, touch screen sensor, or a capacitive sensor. Similarly, the other components can include output components such as video, audio, and/or mechanical outputs. Other examples of output components include audio output components such as alarms and/or buzzers and/or a mechanical output component such as vibrating or motion-based mechanisms. The other components can include a device interface to provide a direct connection to auxiliary components or accessories for additional or enhanced functionality.

In one or more embodiments, the control unit 114 also includes an optional communication circuit 206 that can be configured for wired or wireless communication with one or more other devices or networks. The networks can include a wide area network, a local area network, and/or personal area network. The communication circuit 206 may also utilize wireless technology for communication, such as, but are not limited to, peer-to-peer or ad hoc communications. The communication circuit 206 can include wireless communication circuitry, one of a receiver, a transmitter, or transceiver, and one or more antennas. The communication circuit 206 can, operating in conjunction with the control circuit 203, transmit information to remote electronic devices, such as computer 207, or to "the cloud." For example, the communication circuit 206 can transmit the mattress states stored in the memory 204 to a remote electronic device in one or more embodiments.

Illustrating by example, in one or more embodiments the communication circuit 206 can transmit mattress state information 208 to a trusted remote device such as computer 207. Advantageously, a caregiver, health care services provider, or technician can review the mattress state information 208 at a later date or in real time. This mattress state information 208 can include the state, location, and status of each mattress in a fleet of mattresses. Advantageously, rather than making rounds to inspect beds, a single glance at a terminal instantly identifies which mattresses need to be changed, as well as where the are located. Thus, in a hospital, for example, where mattresses are moved frequently, the system can track the location of each mattress that requires replacement or is near the end of its useful life.

The illustrative mattress state information 208 of FIG. 3 includes an indication of the first predefined threshold 209 and the second predefined weight threshold 210, each of which is shown on a graph 211. In this illustrative embodiment, the Y-axis is marked with units pertaining to a selected metric, which in this case is pressure. The dates in which the data are taken is shown in the lower left hand corner. Arrows 212,213 allow for quick jumps between months. The dates of measurement appear along the X-axis of the graph 211.

Alternatively, in other embodiments representations of the user interface (400) of FIG. 4 can simply be presented. This allows a user to simply glance at colors, identifying any red user interface representations so that those mattresses can be replaced. By clicking on a user interface, the location of the mattress requiring replacement can be easily seen.

It is to be understood that the control unit 114 of FIG. 1, and the schematic block diagram of FIG. 3, are each provided for illustrative purposes only and for illustrating components of control unit 114 in accordance with embodiments of the disclosure. Accordingly, for example, the schematic block diagram is not intended to be a complete schematic diagram of the various components required for a pressure measurement device configured in accordance with one or more embodiments of the disclosure. Therefore, other pressure measurement devices in accordance with embodiments of the disclosure may include various other components not shown in FIG. 3, or may include a combination of two or more components or a division of a particular component into two or more separate components, and still be within the scope of the present disclosure.

Figure 6:
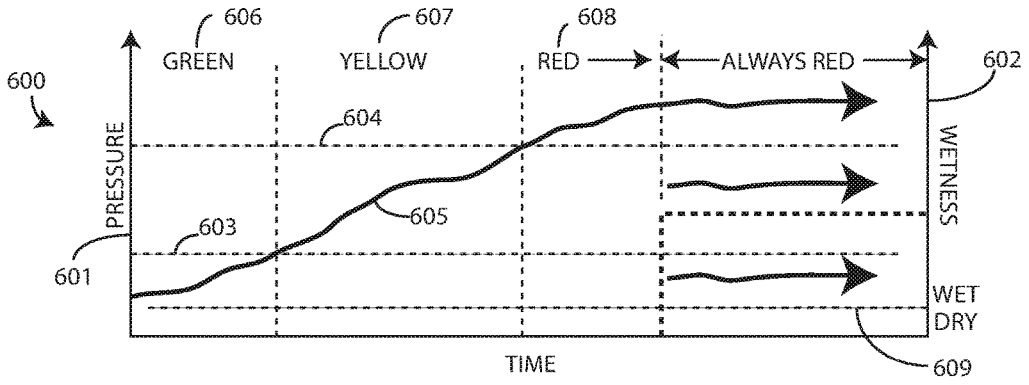
FIG. 6 illustrates sensor readings and corresponding user interface states in accordance with one or more embodiments of the disclosure.

Turning now to FIG. 6, illustrated therein is a graph 600 indicating how the light sources (401,402,403) and/or display (501) are actuated in one or more embodiments. The left vertical axis 601 indicates pressure, as sensed by the one or more pressure sensors (201). The right vertical axis 602 indicates moisture, as sensed by the one or more moisture sensors (202) as previously described.

Beginning with the left vertical axis 601, two thresholds 603,604 are shown. Each threshold 603,604 can be set as a function of various factors. Examples of such factors include the mattress material, the size of the mattress, the number of layers of material within the mattress, and the weight and size of the person using the mattress. Other factors will be obvious to those of ordinary skill in the art having the benefit of this disclosure.

Illustrating by example, in one embodiment the thresholds 603,604 are set as a function of the compression resistance of the material used to manufacture the mattress. Where three layers of foam are used for instance, this foam has a compression resistance that is a function of porosity and elastomerics of the foam. When these factors degrade by a third, this causes the pressure sensors (201) to sense more pressure than they do initially. Similarly, when these factors degrade by two-thirds, the pressure sensors (201) measure even more pressure.

Figure 7:
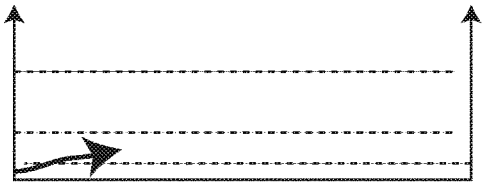
FIG. 7 illustrates one explanatory sensor reading and a corresponding user interface state in accordance with one or more embodiments of the disclosure.
Figure 7:
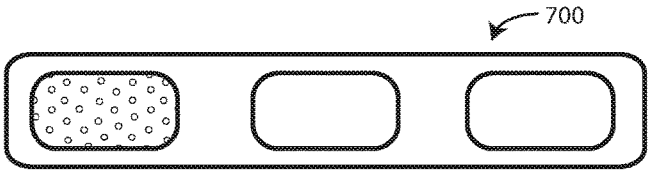
Figure 8:
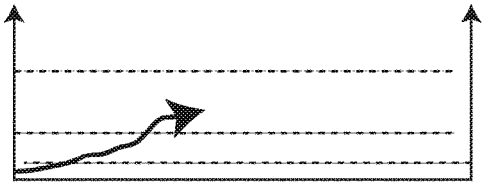
FIG. 8 illustrates another explanatory sensor reading and a corresponding user interface state in accordance with one or more embodiments of the disclosure.
Figure 8:
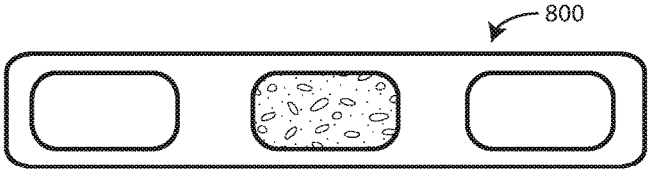

Accordingly, in one embodiment, when the sensed pressure 605 is below the first threshold 603, the mattress is within its useful lifespan and a first indicator, here a green light 606, is presented on the user interface. Such a scenario 700 is shown in FIG. 7. However, when the sensed pressure 605 is above the first threshold 603, but below the second threshold 604, the mattress is approaching the end of its useful lifespan. Accordingly, a second indicator, here a yellow light 607, is presented on the user interface. Such a scenario 800 is shown in FIG. 8.

Figure 9:
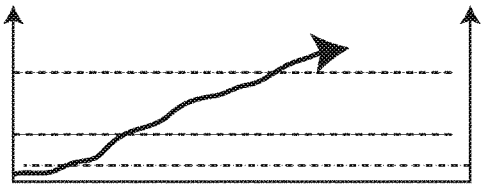
FIG. 9 illustrates yet another explanatory sensor reading and a corresponding user interface state in accordance with one or more embodiments of the disclosure.
Figure 9:
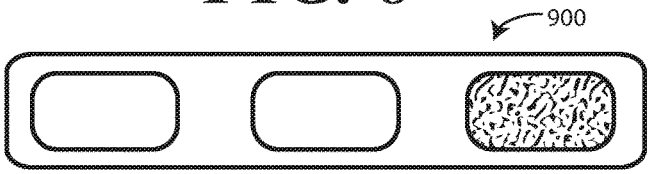

When the sensed pressure 605 is above the second threshold 604, the mattress has exceeded its useful lifespan and should be replaced. Thus, in one or more embodiments a third indicator, here a red light 608, is presented on the user interface. Such a scenario 900 is shown in FIG. 9.

Figure 10:
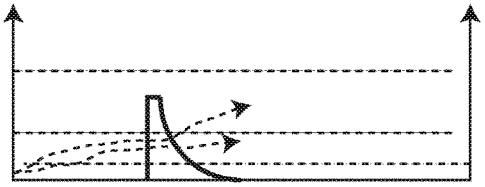
FIG. 10 illustrates still another explanatory sensor reading and a corresponding user interface state in accordance with one or more embodiments of the disclosure.
Figure 10:
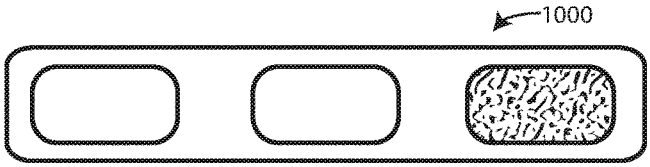

As noted above, embodiments of the disclosure contemplate that when moisture is prevalent in amounts sufficient to penetrate at least one layer, especially when the layer is foam, the mattress needs to be replaced. Accordingly, in one or more embodiments, when the moisture sensors (202) indicate moisture above a wet/dry threshold 609, the third indicator, here the red light 608, is presented on the user interface regardless of whether the sensed pressure 605 is below any of the second threshold 604 or the first threshold 603. Such a scenario 1000 is shown in FIG. 10.

Figure 11:
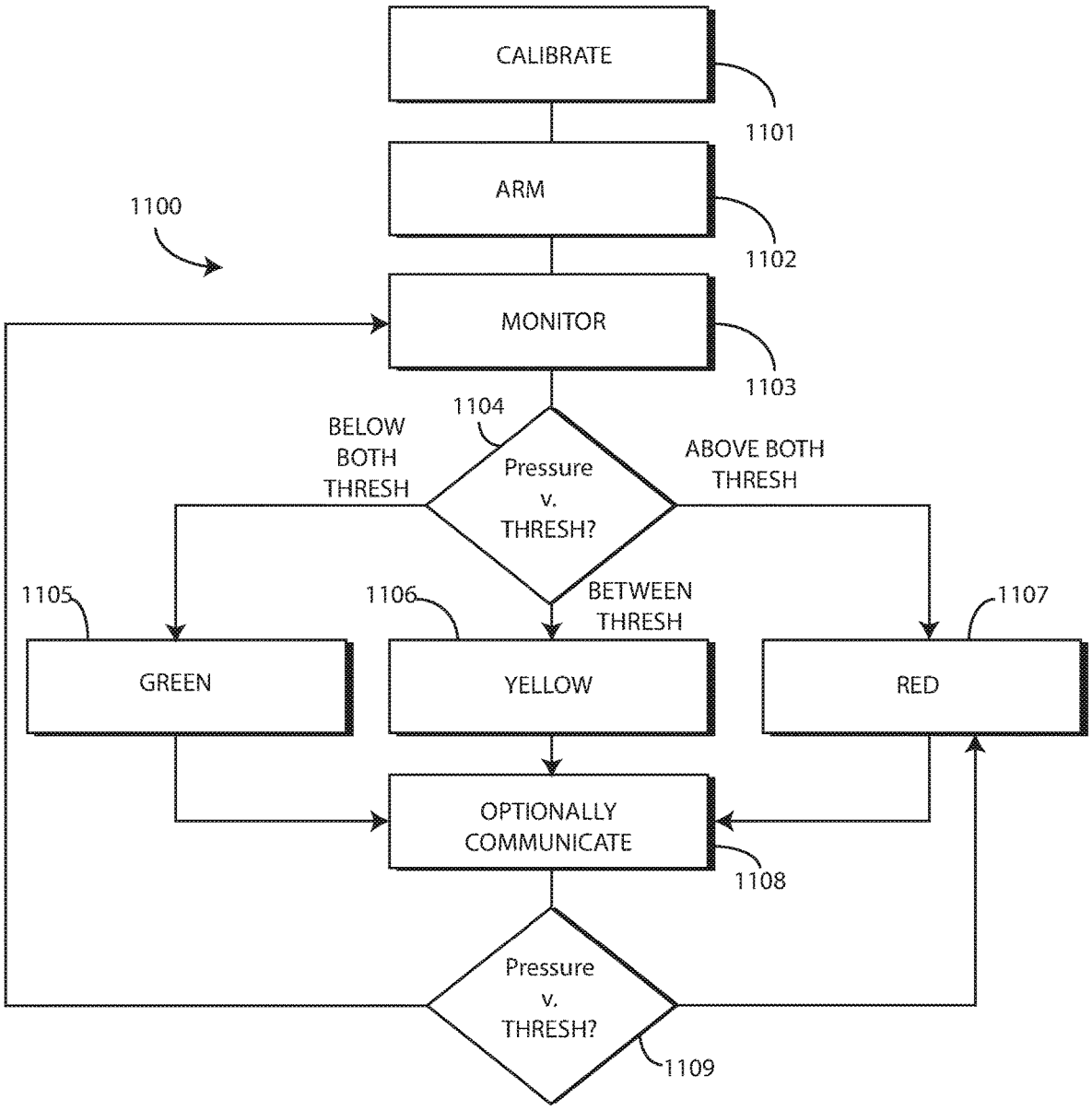
FIG. 11 illustrates one explanatory method in accordance with one or more embodiments of the disclosure.

Turning to FIG. 11, illustrated therein is one method 1100 configured in accordance with one or more embodiments of the disclosure. At step 1101, the method 1100 includes calibrating one or both of pressure sensors and moisture sensors. As noted above, this calibration can occur in a variety of ways. In one embodiment, the calibration occurring at step 1101 occurs as a function of mattress material, number of mattress layers, mattress size, patient weight, and combinations thereof. However, other calibration methods will be obvious to those of ordinary skill in the art having the benefit of this disclosure.

Illustrating by example, manufacturer information about the material used to manufacture the mattress can be used as a calibration standard. From this standard, pressure detected by a pressure sensor can determine, when a person lies on the mattress, an initial compression resistance that will be used as a basis from which to calculate the predefined thresholds. Adjustments to the calibration standard can be made as a function of time, i.e., the calibration standard can be adjusted for the length of time the mattress is in service. This example is illustrative only. Others will be readily obvious to those of ordinary skill in the art having the benefit of this disclosure.

At step 1102, the pressure sensors and/or moisture sensors are actuated. At step 1103, the pressure sensors and/or moisture sensors monitor pressure and/or moisture.

Decision 1104 compares the pressure, with a control circuit, to at least a first predefined pressure threshold and a second predefined pressure threshold. In one or more embodiments, predefined parameters for setting the predefined thresholds are a function of at least mattress material, number of mattress material layers, and the weight of a user who will use the mattress.

After decision 1104, the method 1100 in one embodiment comprises presenting an indication regarding whether the mattress is within its useful lifespan, is approaching the end of its useful lifespan, or has exceeded its useful lifespan. In one embodiment, as shown at step 1105, when the pressure is below the first predefined pressure threshold, the mattress is within its useful lifespan. Thus, at step 1105, in one embodiment the method 1100 presents a first color indication. In one embodiment, the first color indication comprises the presentation of a green light.

However, where the pressure is between the first predefined pressure threshold and the second predefined pressure threshold, the mattress is approaching the end of its useful lifespan. Accordingly, in one embodiment at step 1106 the method 1100 includes presenting a second color indication. In one embodiment, the second color indication comprises the presentation of yellow light.

When the pressure is above the second predefined pressure threshold, in one embodiment this means that the mattress has exceeded its useful lifespan. Thus, in one embodiment at step 1107 the method 1100 includes presenting a third color indication. In one embodiment, the third color indication comprises the presentation of red light.

At step 1108, the method 1100 can include communicating the findings of the status presented in steps 1105,1106, 1107 to a remote device. For example, in one embodiment this status can be communicated, by wire or wirelessly, to a computer or other device so that results can be aggregated for a health care provider or other party interested in ensuring a fleet of mattresses remains within its useful lifespan. Alternatively, the status can be communicated across a network to a cloud device or server for similar aggregation. Other options for communication and aggregation will be obvious to those of ordinary skill in the art having the benefit of this disclosure.

At optional decision 1109, the method 1100 detects whether moisture is found between one or more of the layers of the mattress. Where it has, in one or more embodiments the method 1100 moves to step 1107, where the third color indication is presented. This third color indicates that the mattress needs to be replaced. In one or more embodiments, after the detection of moisture the method 1100 automatically moves to step 1107 regardless of the outcome of decision 1104.

In the foregoing specification, specific embodiments of the present disclosure have been described. However, one of ordinary skill in the art appreciates that various modifications and changes can be made without departing from the scope of the present disclosure as set forth in the claims below. Thus, while preferred embodiments of the disclosure have been illustrated and described, it is clear that the disclosure is not so limited. Numerous modifications, changes, variations, substitutions, and equivalents will occur to those skilled in the art without departing from the spirit and scope of the present disclosure as defined by the following claims. Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims.

What is claimed is:

1. A mattress, comprising:

one or more pressure sensors disposed between a first layer of material and a second layer of material;

a control circuit, operable with the one or more pressure sensors; and a user interface, operable with the control circuit and comprising a display, the control circuit selectively presenting on the user interface one of three color-coded indications;

wherein:

when a sensed pressure detected by the one or more pressure sensors is below a first predefined sensor threshold, the control circuit presents:

a first color-coded indication on the user interface, the first color-coded indication comprising a green light presentation indicating that the mattress is within its useful lifespan; and first information on the display, the first information indicating that the mattress is within a useful lifespan;

when the sensed pressure is between the first predefined sensor threshold and a second predefined sensor threshold, the control circuit presents:

a second color-coded indication on the user interface, the second color-coded indication comprising a yellow light presentation indicating that the mattress is approaching the useful lifespan; and different information on the display, the different information indicating that the mattress is approaching an end of the useful lifespan; and when the sensed pressure is above the second predefined sensor threshold, the control circuit presents:

a third color-coded indication on the user interface, the third color-coded indication comprises a red light presentation indicating that the mattress has exceeded the useful lifespan; and third information on the display, the third information indicating that the mattress has exceeded the useful lifespan.

2. The mattress of claim 1, wherein the mattress is manufactured from foam.

3. The mattress of claim 2, wherein the foam of the first layer of material is different from the foam of the second layer of material.

4. The mattress of claim 3, wherein the foam of the first layer of material is softer than the foam of the second layer of material.

5. The mattress of claim 1, the user interface comprising three light sources, each separate from another.

6. The mattress of claim 5, the display separate from the three light sources.

7. The mattress of claim 1, wherein the first layer of material comprises an uppermost layer of the mattress and the second layer of material comprises a second uppermost layer of the mattress.

8. The mattress of claim 1, the first information comprising a word, the word being GOOD.

9. The mattress of claim 1, the different information comprising a different word, the different word being WATCH.

10. The mattress of claim 1, the third information comprising a third word, the third word being REPLACE.

11. The mattress of claim 1, further comprising a communication circuit, the communication circuit communicating the one of three color-coded indications to a remote device across a network.

12. The mattress of claim 1, the user interface comprising a red light, a yellow light, and a green light, each separate from another.

13. The mattress of claim 1, wherein the one or more pressure sensors comprise a plurality of pressure sensors arranged in an array.

14. The mattress of claim 1, wherein the one or more pressure sensors are calibrated such that at least a predetermined force is required for the one or more pressure sensors to measure the sensed pressure.

15. The mattress of claim 1, further comprising one or more moisture sensors disposed between the first layer of material and the second layer of material.

16. The mattress of claim 1, wherein the display further presents the sensed pressure on a graph.

17. The mattress of claim 16, the graph comprising one or more thresholds that are a function of a material of the mattress, a size of the mattress, a number of layers of material within the mattress, a weight of a person using the mattress, a size of the person using the mattress, or combinations thereof.

18. The mattress of claim 16, further comprising one or more moisture sensors disposed between the first layer of material and the second layer of material, wherein the graph further comprises an indication of moisture sensed by the one or more moisture sensors.

19. The mattress of claim 1, further comprising one or more temperature sensors operable with the control circuit.

20. The mattress of claim 1, further comprising a geolocation sensor operable with the control circuit.

* * * * *